United States Patent [19]

Tamura et al.

[11] Patent Number: 4,471,262

[45] Date of Patent: Sep. 11, 1984

[54] CATHODE RAY TUBE WITH TRANSPARENT METAL OXIDE PROTECTIVE LAYER ON PHOSPHOR SCREEN

[75] Inventors: Michio Tamura, Fujisawa; Teruyasu Suzuki, Yokosuka; Toshihisa Kojima, Warabi, all of Japan

[73] Assignee: Sony Corporation, Tokyo, Japan

[21] Appl. No.: 386,915

[22] Filed: Jun. 10, 1982

[30] Foreign Application Priority Data

Jun. 15, 1981 [JP] Japan ..... 56-87832[U]

[51] Int. Cl.[3] ..... H01J 29/28

[52] U.S. Cl. ..... 313/466; 313/461; 313/473

[58] Field of Search ..... 313/466, 473, 461, 370

[56] References Cited

U.S. PATENT DOCUMENTS 2,372,359 3/1945 Cook ..... 313/466 X
2,879,444 3/1959 Nunan ..... 313/466 X
4,340,839 7/1982 Fujita et al. ..... 313/466

FOREIGN PATENT DOCUMENTS 48839 4/1982 European Pat. Off. ..... 313/461
596428 1/1948 United Kingdom ..... 313/466

*Primary Examiner*—Eugene R. LaRoche
*Assistant Examiner*—Vincent DeLuca
*Attorney, Agent, or Firm*—Hill, Van Santen, Steadman & Simpson

[57] ABSTRACT

A cathode ray tube having, a panel portion provided with a phosphor screen on its inner surface, a neck portion provided with an electron gun in its inner space, and a funnel portion combined with the panel portion and the neck portion to provide an envelope, in which the electron beam emitted from the electron gun scans the phosphor screen and produces images, and the images are observed from the beam scanning side of the phosphor screen. In the cathode ray tube a thin metal oxide layer is formed on the beam scanning side of the phosphor screen.

3 Claims, 5 Drawing Figures

CATHODE RAY TUBE WITH TRANSPARENT METAL OXIDE PROTECTIVE LAYER ON PHOSPHOR SCREEN

BACKGROUND OF THE INVENTION

1. Field of the Invention

The present invention relates to a cathode ray tube and is directed more particularly to a cathode ray tube in which a light image is observed from its phosphor screen on the side where the electron beam scans.

2. Description of the Prior Art

In a cathode ray tube, the phosphor screen formed on the inner surface of a panel portion of its envelope is impinged with the electron beam emitted from an electron gun located within the neck portion of the envelope to excite the phosphor screen to thereby emit light and hence to produce an image. In a cathode ray tube in which the light image on the phosphor screen is to be observed from the panel side of the envelope, i.e., the side of the glass opposite to that on which the electron beam is impinged, a metal back made of an aluminium layer of a thickness from about 1000 Å to 4000 Å is generally coated on the side of the phosphor screen on which the electron beam is impinged. Therefore, the problem that negative ions accelerated to the phosphor screen by the high voltage provided to the phosphor screen within the envelope impinge directly on the phosphor screen (causing deterioration of its luminance or so-called ion burn) is avoided.

In case of such a cathode ray tube wherein the emitted light image from the phosphor screen is observed from the side of the phosphor screen which is scanned by the electron beam, the aforesaid metal back is not formed on that side of the phosphor screen due to the fact that the light image is derived or observed from that side of the phosphor screen. In this case, since the electron beam directly scans the phosphor screen, the ions which are accelerated impinge on the phosphor screen directly and hence the problem of ion burn is caused.

As methods to avoid the above ion burn there are proposed methods such as to locate a magnet for an ion trap, magnet focus means, and so forth. However, any of such proposed methods result in a construction in which the whole length of the cathode ray tube becomes undesirably long.

OBJECTS AND SUMMARY OF THE INVENTION

Accordingly, it is an object of the present invention to provide a cathode ray tube free from the defects inherent to the prior art.

It is another object of the invention to provide a cathode ray tube which can avoid a so-called ion burn effectively without providing an ion trap means and so forth.

According to an aspect of the present invention a cathode ray tube is provided which comprises:

(a) a panel portion provided with a phosphor screen on its inner surface;

(b) a neck portion provided with an electron gun in its inner space; and (c) a funnel portion coupling said panel portion and said neck portion, an electron beam emitted from said electron gun scanning said phosphor screen and producing images, and said images being observed from the beam scanning side of said phosphor screen, characterized in that a thin metal oxide layer is formed on said beam scanning side of said phosphor screen.

The other objects, features and advantages of the present invention will become apparent from the following description taken in conjunction with the accompanying drawings through which the like references designate the same elements and parts.

DESCRIPTION OF THE PREFERRED EMBODIMENT

An example of the present invention will be hereinbelow described with reference to the attached drawings in which the present invention is applied to a flat cathode ray tube.

Figure 1:
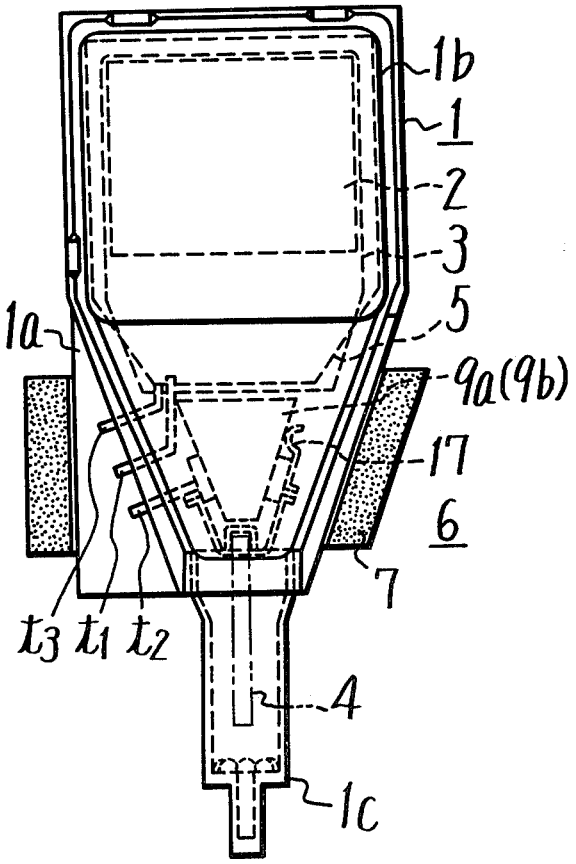
FIG. 1 is a rear view of a cathode ray tube according to the present invention.
Figure 2:
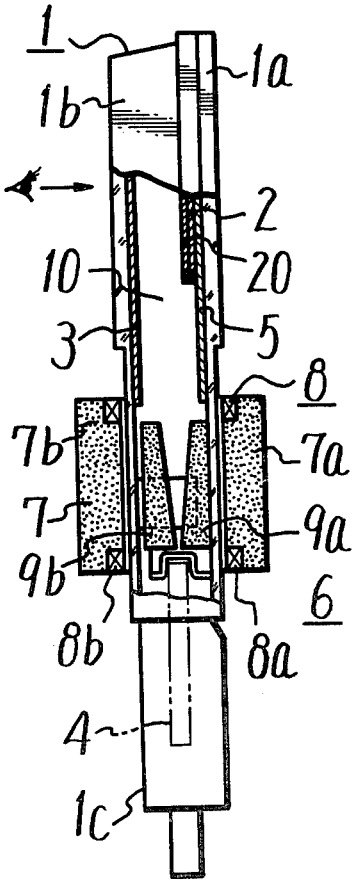
FIG. 2 is its side view partially in cross-section.

FIG. 1 is a rear view of the flat cathode ray tube according to the invention and FIG. 2 is a side view partially in cross-section thereof. In the figures, reference numeral 1 designates a flat envelope of the cathode ray tube. Within the flat envelope 1 are located a phosphor screen 2 and a rear electrode 3 which are respectively arranged along the flat surfaces of the flat envelope 1, namely opposed to each other in the thickness direction of the flat envelope 1.

This flat envelope 1 consists of a panel 1*a* made of, for example, a flat glass plate, a glass funnel 1*b* bonded to one surface of the panel 1*a* to define a flat space 10 between them and a glass neck tube 1*c* which is coupled to the panel 1*a* and the funnel 1*b* at the one side thereof to communicate therewith and to be extended in the surface direction of the flat space 10 and includes therein an electron gun 4.

Figure 3:
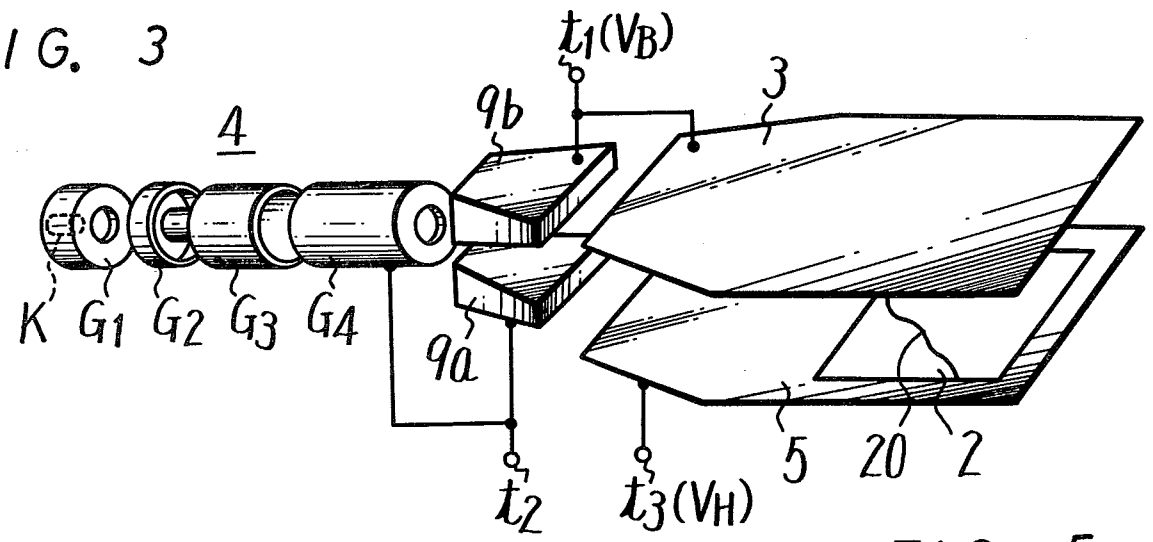
FIG. 3 is a perspective view showing the arrangement of its main parts.

As shown in FIG. 3, the electron gun 4 can be formed of, for example, a cathode K, a first grid $G_1$, a second grid $G_2$, a third grid $G_3$ and a fourth grid $G_4$ arranged sequentially in this order.

The rear electrode 3 is made of, for example, a transparent conductive layer evaporated on the inner surface of the funnel 1*b*.

Figure 4:
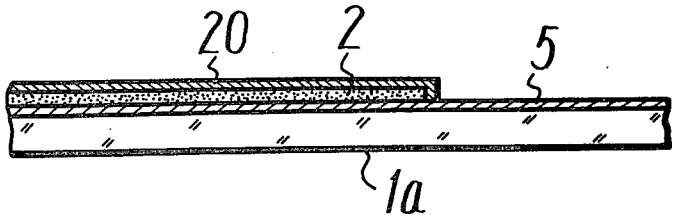
FIG. 4 is a cross-sectional view of its essential parts.

As shown in FIG. 4, opposing the transparent rear electrode 3, evaporated on the inner surface of the glass panel 1*a*, is a metal layer such as an Al layer with the thickness of several μm to form a target electrode 5. On this target electrode 5 is coated a phosphor made of, for example, ZnS:Au,Ag,Al to form the phosphor screen 2. In this invention, the phosphor screen 2 is covered by a transparent thin metal oxide layer 20 which can be made by, for example, $Al_2O_3$, $SiO_2$,SiO or the like formed by evaporation, chemical vapor deposition (CVD) and so forth. For example, an $Al_2O_3$ layer may be formed by Al evaporation under low vacuum. Further, the thin metal oxide layer 20 may be made by such a manner that Al is evaporated on the phosphor screen 2 up to about 200 Å to 800 Å and then this Al layer is oxidized by a thermal treatment or the combination of thermal treatment with a chemical treatment to provide aluminum oxide. The thermal treatment does not need a separate special thermal treatment process but may be carried out during other thermal treatment necessary to the manufacturing process of the cathode ray tube such as the frit seal process or the like. Since the Al layer forming the target electrode 5 is selected sufficiently thick as compared with the thin metal oxide layer 20, only the surface of the target electrode 5 is oxidized by the above thermal treatment. Accordingly, no problem occurs when the necessary voltage, described later, is applied to the target electrode 5.

The metal oxide layer 20 is selected to have the thickness of 200 Å to 3000 Å, preferably 400 Å to 1000 Å.

The target electrode 5, namely phosphor screen 2 has applied thereto a high anode voltage $V_H$, for example, 4 kV, while the rear electrode 3 is supplied with a high voltage $V_B$ lower than the anode voltage $V_H$ to form a first deflection means between the phosphor screen 2 and the rear electrode 3.

Between the electron gun 4 and the phosphor screen 2, a second deflection means is provided which serves to deflect the electron beam emitted from the electron gun 4 in both the horizontal and vertical directions. The horizontal deflection is such a deflection that the electron beam emitted from the electron gun 4 is deflected in a direction substantially perpendicular to the axial direction of the electron gun 4 and along the surface direction of the phosphor screen 2 to make the electron beam perform a so-called horizontal scanning on the phosphor screen 2, while the vertical deflection is a deflection such that the electron beam is deflected in the direction perpendicular to the phosphor screen 2. In FIGS. 1 and 2, reference numeral 6 generally designates the above-mentioned horizontal and vertical deflection means which perform horizontal deflection of a relatively large deflection angle by the electro-magnetic deflection and the vertical deflection by the electrostatic deflection. A pair of inner pole pieces used to perform the electro-magnetic horizontal deflection are also used as electrostatic deflection plates 9*a* and 9*b*.

As shown in FIGS. 1 and 2, the deflection means 6 is formed of an annular magnetic core 7, which is made of, for example, ferrite with high magnetic permeability, and located at the post stage of the electron gun 4 to surround the outer periphery of the envelope 1, and a winding 8 (or windings 8*a*, 8*b*) which is supplied with horizontal deflection current. A pair of ferrite deflection plates 9*a* and 9*b* are each made of high magnetic permeability material such as Ni-Zn ferrite, Mn-Zn ferrite or the like and serve as the inner magnetic deflection pole pieces and also the electro-static deflection plates.

The magnetic core 7 is of an annular shape to surround the outer periphery of the envelope 1 as set forth above and includes outer center poles 7*a* and 7*b* which are so extended that they oppose each other in the thickness direction of the envelope 1 across the path of the electron beam. The windings 8*a* and 8*b* are respectively wound on the peripheries of the outer center poles 7*a* and 7*b*. In this case, the winding is wound on the periphery of either one of the outer center poles 8*a* and 8*b*. Thus, the magnetic flux responsive to the horizontal deflection current flowing through the winding 8 (or 8*a* and 8*b*) is generated between the outer center poles 7*a* and 7*b*. Further, between the inner pole pieces which also serve as the electro-static deflection plates 9*a* and 9*b* and located between the outer center pole pieces 7*a* and 7*b*, a magnetic field is generated which intersects the path of the electron beam.

The inner pole pieces serving also as the electrostratic deflection plates 9*a* and 9*b* within the envelope 1 are located opposite to each other at the both sides of the electron beam path with respect to the thickness direction of the envelope 1. The ferrite deflection plates 9*a* and 9*b* are formed of a trapezoid such that the vertical distance therebetween becomes wider in the direction toward the phosphor screen and the horizontal width of each of them becomes wider in the direction of the phosphor screen. These ferrite deflection plates 9*a* and 9*b* function to converge the magnetic flux originated from the outer center poles 7*a* and 7*b* to the electron beam path.

As shown in FIG. 3, one deflection plate 9*b* of the deflection means 6 located at the side of the rear electrode 3 is electrically connected to the rear electrode 3 and a terminal $t_1$ is led out from the connecting point therebetween to which the predetermined DC voltage $V_B$ is supplied. The other deflection plate 9*a* located at the side of the phosphor screen 2 is electrically connected by contact pin 17 to the final post electrode of the electron gun 4, for example, the fourth grid $G_4$ and a terminal $t_2$ is led out from the connecting point therebetween to which the predetermined DC voltage superimposed with the signal voltage of the vertical deflection and the signal voltage correcting the pincushion distortion is supplied. From the target electrode 5, a terminal $t_3$ is led out, to which the aforementioned voltage $V_H$ is supplied.

As set forth above, by the cooperation of the first and second deflection means, the electron beam emitted from the electron gun 4 scans through the thin metal oxide layer 20 to the phosphor screen 2 in the horizontal and vertical directions.

When the phosphor screen 2 is scanned by the electron beam, it is excited and produces a light image pattern thereon in response to the density modulation of the electron beam. In this flat cathode ray tube, the light image thus generated is observed at the electron beam scanning side or the side of the funnel 1*b* in case of FIGS. 1 and 2 through the transparent rear electrode 3. Since the thin metal oxide layer 20 formed on the phosphor screen 2 is transparent, the light image generated on the phosphor screen 2 can be observed at the electron beam scanning side or the side having the metal oxide layer 20 therethrough.

As described above, according to the present invention, the side of the phosphor screen 2 on which the electron beam impinges, is covered by the thin metal oxide layer 20, so that an ion large in particle size can be effectively prevented from passing through the thin metal oxide layer 20 and hence the phosphor screen 2 is effectively prevented from being impinged on by large size ions. Therefore, the phosphor screen can be effectively prevented from ion burn and deterioration in luminance.

In the case where the phosphor screen 2 is made of the aforesaid phosphor ZnS : Au, Ag, Al in which the so-called ion burn is easily caused, it has been ascertained that substantially no ion burn appears in case of this invention.

In case of the above flat cathode ray tube, it was ascertained that when no metal oxide layer is provided, the ion burn appears after a driving of several seconds, while when the metal oxide layer is provided as in this invention, no ion burn occurs even after a driving of several thousand hours.

The thickness of the metal oxide layer 20 is selected in the range from 200Å to 3000Å, preferably from 400Å to 1000Å. The reason of this thickness selection is that if the metal oxide layer is too thin, its shielding effect for the accelerated ion disappears, while if it is too thick, the amount of the light from the phosphor screen 2 passing therethrough is decreased. When the above-mentioned anode voltage (accelerating voltage) $V_H$ is selected as about 4kV, the thickness of the metal oxide layer 20 is preferably selected in the range from 600Å to 800Å.

Figure 5:
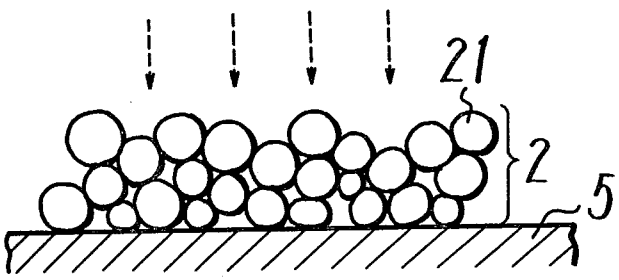
FIG. 5 is a cross-sectional view showing, in an enlarged scale, its essential parts.

In fact, the surface of the phosphor screen 2 is a rough or convex-concave surface provided by the phosphor particles 21 as shown in FIG. 5. Accordingly, when the metal oxide layer 20 (not shown in FIG. 5) is formed on the phosphor screen 2 or phosphor particles 21 along the vertical direction as indicated by broken line arrows by evaporation, there may occur a case where no layer 20 is formed on the side surface of the phosphor particles 21 or the side surface of the rough surface. Especially, in case of the above flat cathode ray tube in which the accelerated ion obliquely impinges on the phosphor screen 2 with an angle about from 15° to 20° with respect to the direction along the phosphor screen 2, the exposed side surface of the phosphor particle is directly impinged with the accelerated ion to cause the ion burn. Therefore, it is preferred that the evaporation of metal to form the metal oxide layer 20 is of the so-called oblique evaporation technique so as to form the metal oxide layer 20 even on the side surface of the phosphor particles on the surface portion of the phosphor screen 2.

In some cases, it may be possible that an intermediate layer made of acrylic lacquer, acrylic emulsion, or the like, is coated on the surface of the phosphor screen. Then the metal oxide layer 20 is formed on the intermediate layer and thereafter the intermediate layer is spattered away by the baking of the phosphor.

The above description is given on the preferred embodiments of the invention, but it will be apparent that many modifications and variations could be effected by one skilled in the art without departing from the spirit or scope of the novel concepts of the invention, so that the scope of the invention should be determined by the appended claims only.

We claim as our invention:

1. A cathode ray tube comprising:

(a) a panel portion provided with a phosphor screen on its inner surface;

(b) a neck portion provided with an electron gun in its inner space; and (c) a funnel portion coupling said panel portion and said neck portion, an electron beam emitted from said electron gun scanning said phosphor screen and producing images, and said images being observed from the beam-scanning side of said phosphor screen, characterized in that a thin transparent metal oxide layer is formed on said beam scanning side of said phosphor screen.

2. A cathode ray tube according to claim 1, wherein a thickness of said thin oxide layer is selected in the range from 200Å to 3000Å.

3. A cathode ray tube according to claim 1, wherein said thin oxide layer is at least one member of the group consisting of $Al_2O_3$,$SiO_2$ and SiO.

* * * * *